US006278431B1

(12) United States Patent
Kao

(10) Patent No.: US 6,278,431 B1
(45) Date of Patent: Aug. 21, 2001

(54) MAGNETICALLY OPERATED DISPLAY

(75) Inventor: Pin-chi Kao, Hsintien (TW)

(73) Assignee: Lite Vision Corporation, Taipei (TW)

( * ) Notice: Subject to any disclaimer, the term of this patent is extended or adjusted under 35 U.S.C. 154(b) by 0 days.

(21) Appl. No.: 08/751,744

(22) Filed: Nov. 18, 1996

(51) Int. Cl.[7] ..... G09G 3/34
(52) U.S. Cl. ..... 345/111; 40/449
(58) Field of Search ..... 345/108, 109, 345/110, 111, 46, 82; 40/449, 446; 340/815.62

(56) References Cited

U.S. PATENT DOCUMENTS 4,426,799 * 1/1984 Winrow ..... 40/449
4,744,163 * 5/1988 Browne et al. ..... 40/449
5,050,325 * 9/1991 Browne ..... 40/447

* cited by examiner

*Primary Examiner*—Vijay Shankar
*Assistant Examiner*—Vanel Frenel
(74) *Attorney, Agent, or Firm*—Patterson, Thuente, Skaar & Christensen

(57) ABSTRACT

A magnetically operated display unit includes a frame with a color, a plate pivotably mounted on the frame and including a first surface with a color different to that of the frame and a second surface with a color identical to that of the frame, a magnet embedded in the plate, a pair of bobbins mounted on the frame so that two tips of the magnet are located between two tips of the pair of bobbins, a solenoid mounted on the U-shaped ferromagnetic element and a light emitting diode mounted on the frame. The plate defines a cutout for receiving the light emitting diode and one of the bobbins. The light emitting diode includes a tip located on a level between the plate and the tips of the pair of bobbins. Opposite polarities are selectively induced in the pair of bobbins.

13 Claims, 5 Drawing Sheets

MAGNETICALLY OPERATED DISPLAY

BACKGROUND OF THE INVENTION

This invention relates to a magnetically operated display that provides a very wide visible viewing angle, excellent readability either in sunlight or darkness with relatively low power consumption.

Eye-catching displays are becoming more and more popular due to increasing consumerism and the desire for public awareness of products, public announcements etc. Particularly, the electronic changeable information displays have been accepted worldwide as an effective way for the communication between passengers and vehicle operators.

A first conventional display is the U.S. Pat. No. 5,005,305 by Turney et al. which discloses a magnetically operated display device including contrasting opposite sides and being mounted in a surrounding frame for pivoting about an axis. A permanent magnet within the display element has poles on opposite sides of the pivoting axis. A U-shaped electro-magnet has its pole pieces positioned on opposite sides of the pivoting axis where they may interact with the poles of the permanent magnet. The permanent magnet has a asymmetrical magnetic construction relative to the pivoting axis. When the electromagnet is energized, the repulsion at one pole of the permanent magnet is always greater than at the other pole of the permanent magnet, causing rotation of the display element. The display element is statically and dynamically balanced. The magnetically operated display device as disclosed by Turney et al. does not contain any emitting elements to illuminate the display especially in darkness time. Moreover, Turney does not specifically articulate both color similarity and contrast between its frame and flip element. The first conventional display shows clear images in a bright environment, however, visibility of the first surfaces of the pivotable plates is greatly reduced in darkness as the first surfaces of the plates do not produce light. Therefore, the magnetically operated display device as disclosed by Turney et al., due to lack of illumination elements, is not suitable for use inside a vehicle for the communication between passengers and vehicle operators.

A second conventional display is the U.S. Pat. No. 5,050,325 by Browne which discloses a display indicator with a movable element. The movable element is driven between ON and OFF positions by switching the polarity of a first high remanence magnetic core. A reed switch is located in the flux path of the switchable magnetic core and of a second magnetic core such that the reed switch assumes open and closed states. The reed switch is connected so that one state turns on or exposes a light source and the other state turns off or masks the light source. A plurality of light emitting diodes are located under the movable element for emitting light. However, since the tips of the light emitting diodes of Browne are not located beyond the brightly colored surface, the light emitted from the light emitting diodes does not illuminate the brightly colored surface of the movable element.

A third conventional display is the U.S. Pat. No. 4,264,906 by Wakatake which discloses a display element for use with a display panel which includes a display surface structure having a number of such elements arranged in a vertical plane and each adapted for rotation about support arms provided on the opposite side surfaces thereof, thereby producing a display of a character, graph, pattern, or the like on the display surface structure. The display element is formed with a plate-like (or four-cornered) block member having two (or four) display surfaces of different colors and one (or three) magnetic pieces. Although the display as disclosed by Wakatake provides two display surfaces of Different colors, it lacks an illumination source, therefore this display is not suitable for use in a vehicle for information communications between the vehicle operator and passengers.

A fourth conventional display is the U.S. Pat. No. 4,531,121 by Brown which discloses a visual display element, which may be used singly or as part of a large bank or like and similar elements, each element comprising an encasement, a slotted plate, and actuating assembly. The actuating assembly comprises a planar face with a colored pattern of lines thereon and is situated immediately behind and parallel to the slotted plate. When viewed from the front, the planar face and adjacent slotted plate, the slots of said plate comprise highly reflective surfaces, which collectively appear as a solid color. Selective relative movement between the planar face and the slotted plate causes the visually perceived color to change from one color to a contrasting color and thereafter back to the original color. Each visual display element does not have an independent light source. A light source, when and if needed, may be situated substantially to the rear of several display elements. However, the efficiency of the first conventional display is considerably reduced if the level of environmental light is increased, for example, a sunny day, and thus the noticeability of the display is impaired.

Displays used as the head sign or side sign mounted on vehicles normally have the following constraints:

1. Display needs to have a very wide angle: To provide passengers information, the display has to be readable to riding passengers. For a riding passenger, standing at the curb side to read a head sign mounted on the vehicle, the viewing angle for the display must be around 160° minimum.

2. Contrast ratio: The display readability concerns its contrast ratio. The greater the ratio between the sign legend and sign background, the more readable becomes the display.

3. Pixel size: Due to space limitation on a vehicle, the pixel diameter is normally limited to between 10 millimeters (mm) and 25 millimeters (mm). For displays with a pixel diameter of less than 10 mm, it becomes cost-prohibitive for in the vehicle applications. A display made of small pixels to be readable at long distances (such as 400 to 500 feet), requires a lot of pixels to be stacked. Displays with pixel diameters greater than 25 mm, cannot provide enough resolution for efficient message display.

It is requisite to provide a display designed primarily for vehicle applications which can present clear images at both low ambient light and bright sunlight.

SUMMARY OF THE INVENTION

It is the primary objective of this invention to provide a magnetically operated display unit which presents clear images both in darkness and in bright sunlight.

It is another objective of this invention to provide a magnetically operated display unit which optimizes the positions of a plurality of light emitting diodes in relationship to the magnetically operated flip dot while achieving a maximum viewing angle both day and night. During the day-time, the objective is to maximize the advantage of reflective disk, while during the night-time, the objective is to maximize the advantage of the light emitting diodes. With this invention, the tip of each of the light emitting diodes is positioned in such a way that it can be seen at night with an approximate 160° viewing angle. Furthermore, this invention is targeted for a magnetically operated display including a plurality of pixels each of which has a diameter sized between 10 mm and 25 mm.

The magnetically operated display unit includes a frame with a color, a plate pivotably mounted on the frame and including a first surface with a color different to that of the frame and a second surface with a color identical to that of the frame, a magnet embedded in the plate, a first bobbin and a second bobbin adapted to be mounted on the frame so that two tips of the magnet are located between two tips of the two bobbins, and a light emitting diode mounted on the frame. The plate defines a cutout for receiving the light emitting diode and the tip of the first bobbin. The light emitting diode includes a tip located on a level between the plate and the tips of the U-shaped ferromagnetic element. Opposite polarities are induced in the two bobbins.

It is further an aspect that the physical relationship between the plate, the tips of the two ferromagnetical rods, and the LED are so adapted to each other that the viewers (passengers) may be in a substantially 1600 viewing angle with respect to the display to see the display.

DETAILED DESCRIPTION OF THE DRAWINGS

Figure 1:
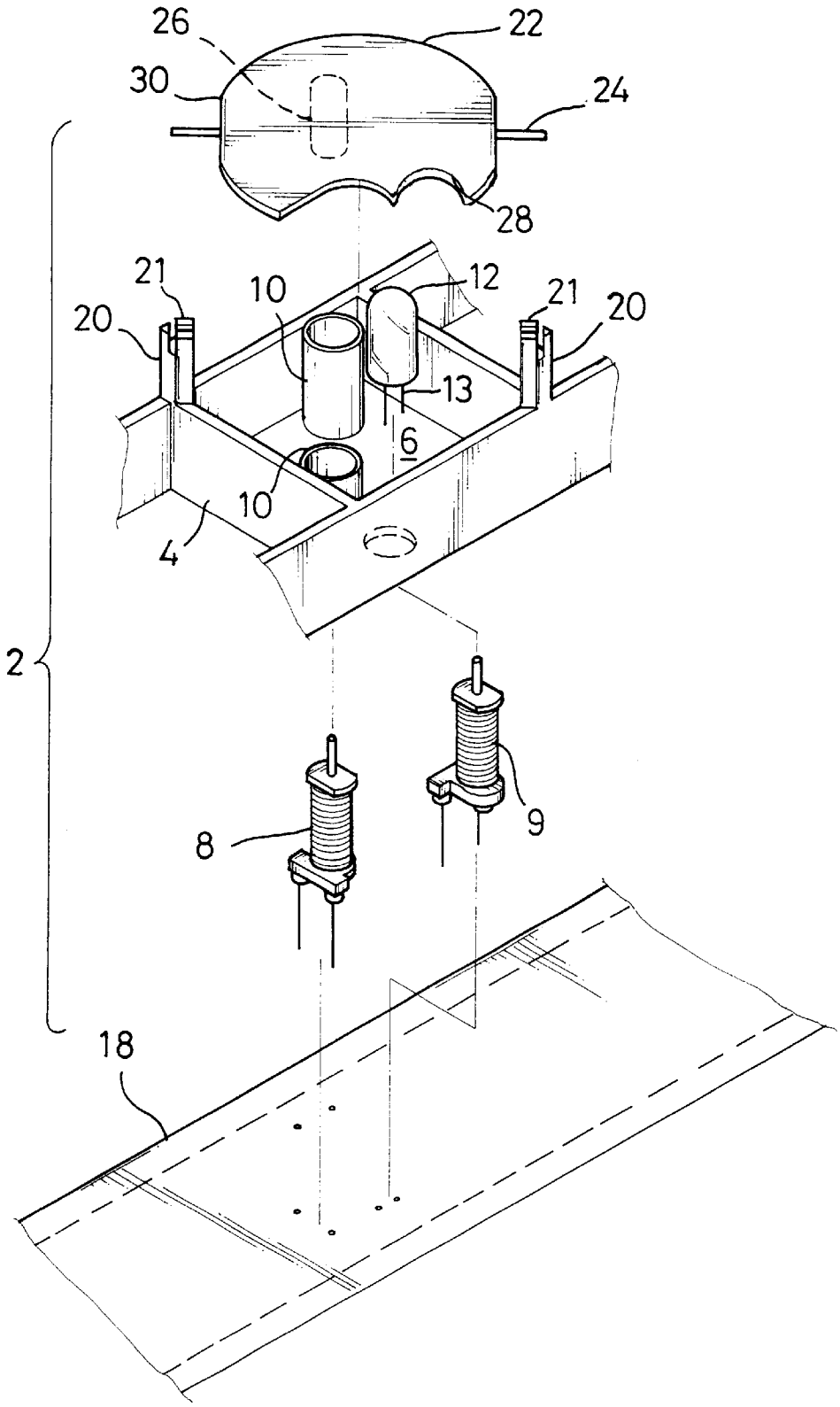
FIG. 1 is an exploded view of a magnetically operated display unit in accordance with the present invention.

FIG. 1 shows a magnetically operated display unit 2 including a frame 4 with a base 6 defining four apertures (not shown). A first bobbin 8, a second bobbin 9, and two leads 13 of a light emitting diode (LED) 12 are correspondingly inserted through the apertures defined in the base 6. The first bobbin 8 and the second bobbin 9 are respectively wound in opposite directions, therefore the induced polarities thereof are opposite to each other. Two tubular sockets 10 are integrated with the frame 4 and each of them is respectively positioned around a corresponding one of the apertures (not shown). The two bobbins 8 and 9 are received and retained by the tubular sockets 10, with only the tips thereof protruding from the tubular sockets 10. The two bobbins 8 and 9 and the LED 12 are electrically connected to a circuit 18.

Two arms 20 project upwardly from the frame 4. Two fingers 21 project upwardly from each of the arms 20. Each of the fingers 21 includes an inner face opposite to the remaining one of the fingers 21. A bulbous portion is formed on the inner face of each of the fingers 21 near a tip thereof thereby defining a narrow entrance to a recess defined between the two fingers 21.

A plate 22 includes a color identical to that of the frame 4. Two axles 24 project from the plate 22 in two opposite directions. Each of the axles 24 is pushed past the tips of the fingers 21 projecting from a corresponding one of the arms 20 so that each of the axles 24 is retained between the fingers 21 projecting from a corresponding one of the arms 20. Thus, the plate 22 is pivotably mounted on the frame 4. A magnet 26 includes a north pole at a tip and a south pole at an opposite tip. The magnet 26 is embedded in the plate 22. The tips of the magnet 26 are located between and in line with the upper tips of the two bobbins 8 and 9. The plate 22 defines a cutout 28 at a first side thereof, through which the upper tip of one the first bobbin 8 and an upper portion of the LED 12 are inserted.

A reflector 30 has a color different from that of the plate 22. The reflector 30 is adhered to the plate 22. The reflector 30 conforms in profile to the plate 22.

Figure 2:
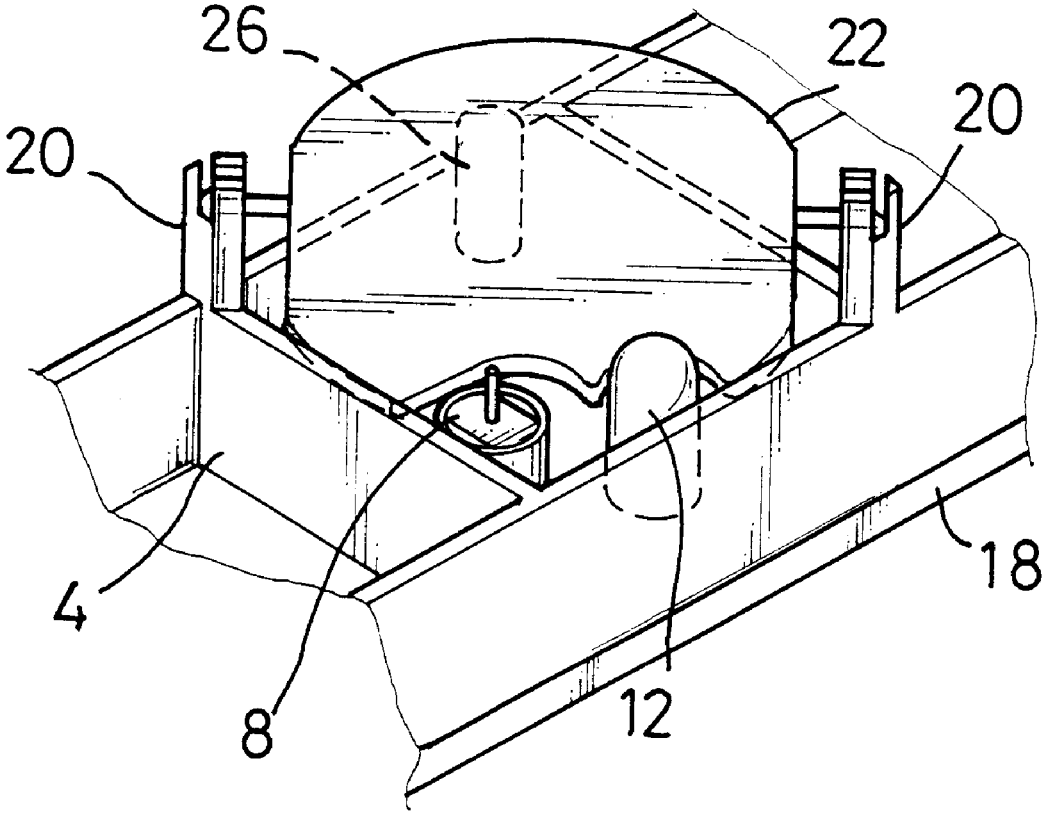
FIG. 2 is an assembled view of FIG. 1.
Figure 3:
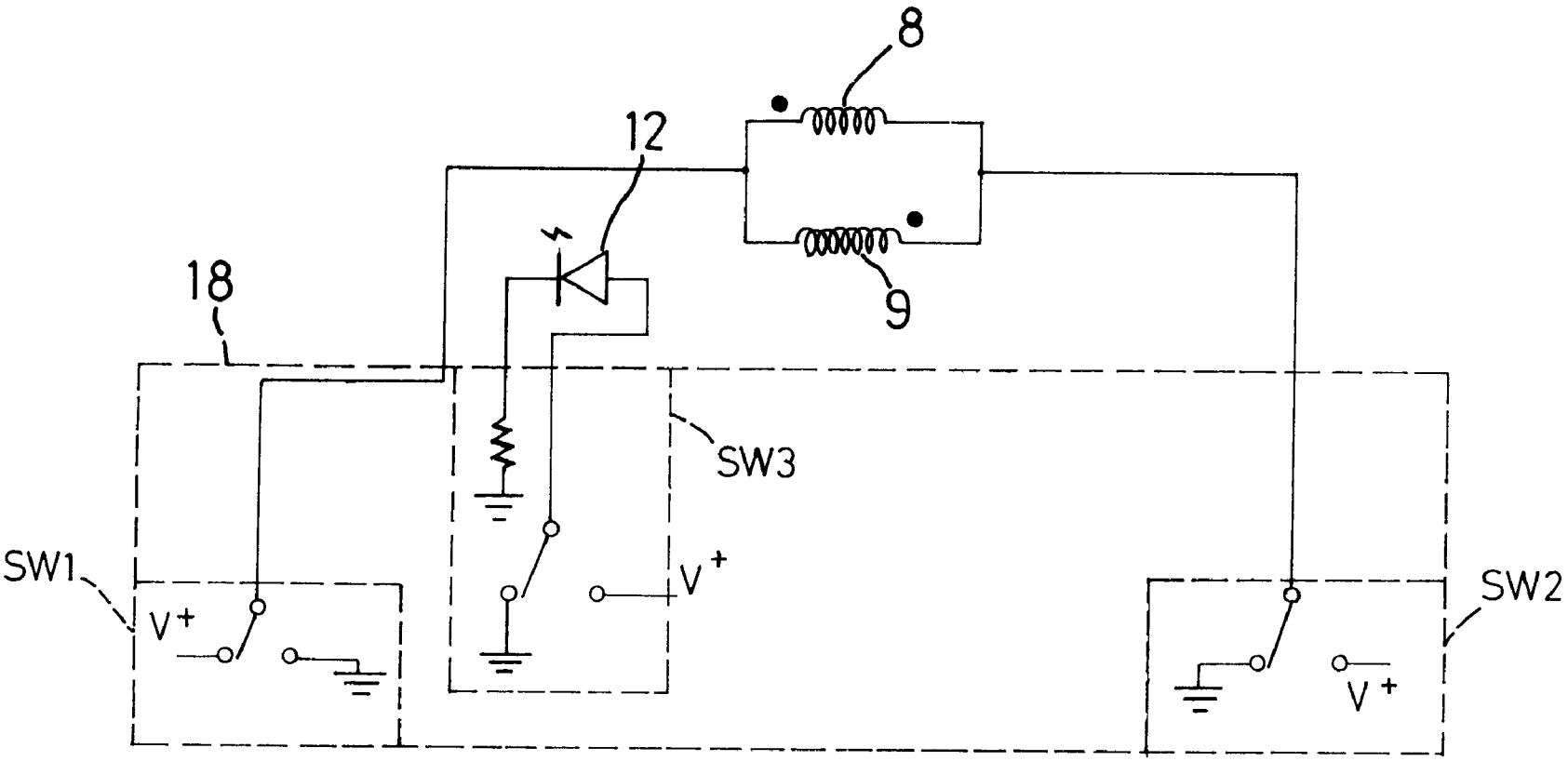
FIG. 3 is a schematic view of the circuit used in the present invention.

Referring to FIG. 3, the circuit 18 includes a first switch SW1, a second switch SW2 and a third switch SW3. The first switch SWi has a constant end connected to the two bobbins 8 and 9 and a free end connected to either a positive electrode V+ or a ground. The second switch SW2 has a constant end connected to two ends of the two bobbins 8 and 9 and a free end connected to either the ground or the positive electrode V+. The third switch SW3 is connected with the LED 12. Each free end of the switches SW1 and SW2 can be oppositely connected between the positive electrode V+ and the ground,i.e., for example, when the free end of the first switch SW1 is connected to the positive electrode V+, the second switch SW2 is connected to the ground, and vice versa. FIG. 2 illustrates an assembled view of FIG. 1, where the assembly is electrically controlled in a first status in which the first bobbin 8 and the LED 12 can be seen by views while the second bobbin 9 is blocked by the plate 22. It should be noted that the plate 22 can also be pivoted to block the first bobbin 8 and the LED 12 when this assembly is electrically controlled in a second status.

As shown in FIG. 3, the first switch SWi is turned to the positive electrode V+ and the second switch SW2 is turned to the ground so as to induce the first bobbin 8 and the second bobbin 9 respectively generate a first magnetic field and a second magnetic field which have opposite polarities. Then, both of the switches SW1 and SW2 can be turned to the positive electrode V+ or the ground electrode whilst the first magnetic field and the second magnetic field remain.

The first switch SW1 can be turned to the ground electrode and the second switch SW2 is turned to the positive electrode V+ so as to reverse the polarities of the first magnetic field and the second magnetic field.

The third switch SW3 can be turned on so that LED 12 emits light. The LED 12 includes an upper tip which should be located above the combination of the plate 22 and the reflector 30 so that the LED 12 is clearly visible. The upper tip of the LED 12 should be located above the upper ends of the two bobbins 8 and 9 so that the plate 22 can contact the fully block the light emitted diode 12 when the reflector 30 of the plate 22 is pivoted to face the light emitting diode 12.

The light emitting diode 12 comprises a lens means which is disposed relative to the first side of the plate 22 to permit a viewing angle such that it casts light on the reflector 30 of the plate 22 under low light conditions. If the magnetically operated display unit 2 is used in a vehicle (not shown), a transparent panel (not shown) is located in front of the magnetically operated display unit.

When the vehicle is driven, there will be friction between air and the transparent panel thus resulting in a static charge in the transparent panel. The combination of the plate 22 and the reflector 30 is pivoted when it is in use thus resulting in a static charge in the magnetically operated display unit 2. The static charge produced in the. transparent panel and the static charge produced in the magnetically operated display unit 2 will attract each other thus causing difficulty for the pivoting of the combination of the plate 22 and the reflector 30. Thus, the static charge produced in the magnetically operated display unit 2 should be removed. A conductive agent is added in the plastic from which the frame 4, the plate 22 and the reflector 30 are made so that frame 4, the plate 22 and the reflector 30 are conductive to a limited extent for releasing the static charge to the leads of the LED 12 for removing the static charge. The above mentioned is the general structure of the magnetically operated display. However, the visible angle of the display is a very important factor in practice. Therefore, it is requisite to arrange the physical relationship between the plate 22, the tips of the two bobbins 8 and 9 , and the tip of the LED 12.

Figure 4:
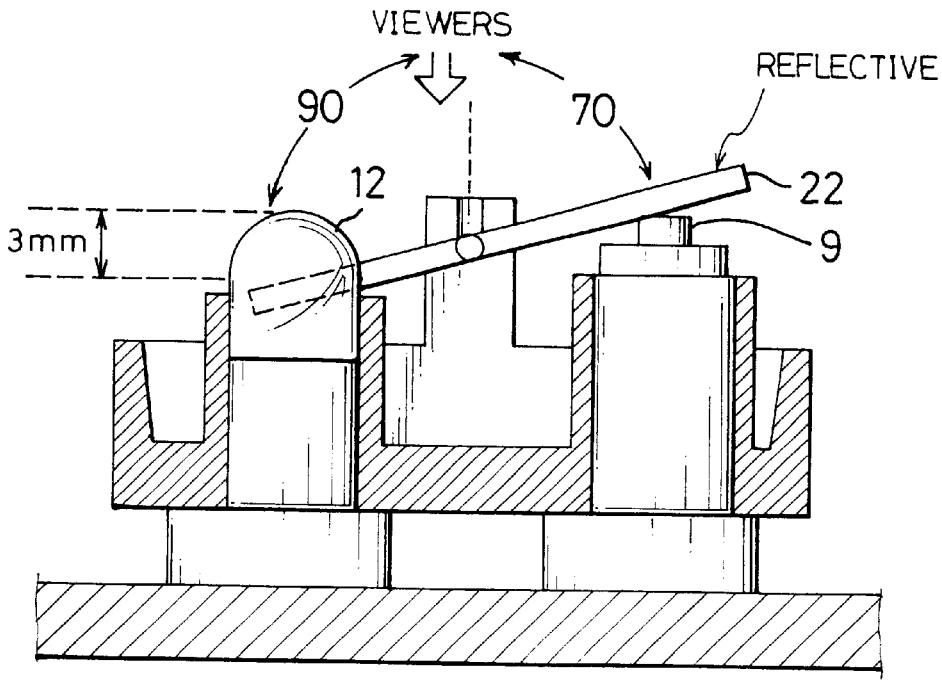
FIG. 4 is a first embodiment showing the reflective surface of the display plate facing to the viewers in a visible angle of 160°.
Figure 5:
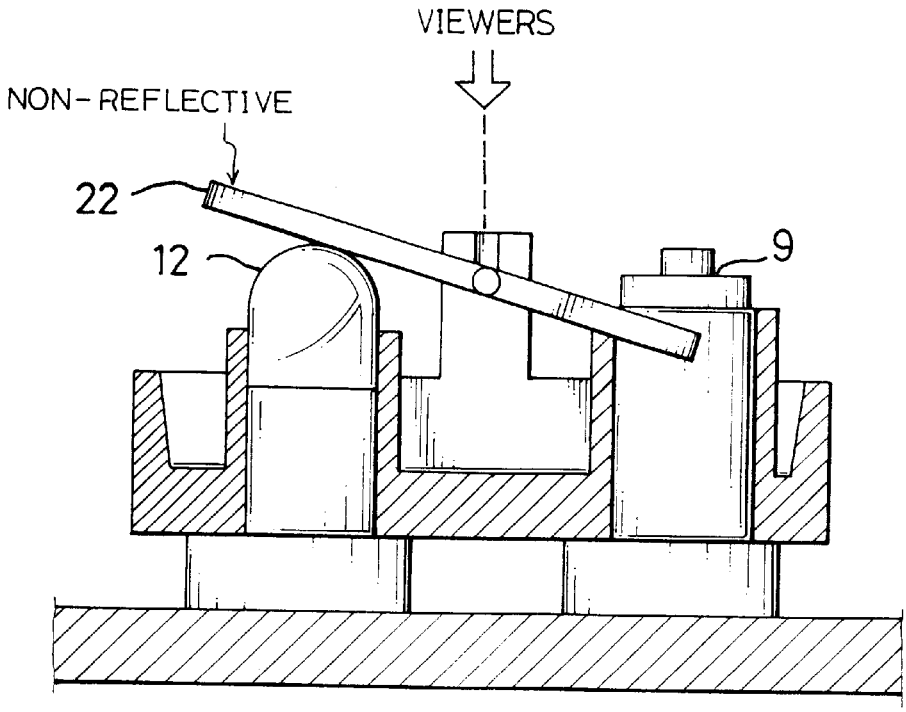
FIG. 5 is another status of the first embodiment, showing that the non-reflective surface of the display plate obscures the LED.

FIGS. 4 and 5 together illustrate a first embodiment of this invention, where each pixel is substantially a square in each side has a 25 mm length. Particularly referring to FIG. 4, the viewers (passengers) may be in a substantially 160° viewing angle with respect to the display to see the display, where the reflective surface 30 of the plate 22 is positioned outward the viewers, with the LED protruding from the cutout 28, the non-reflective surface having an edge portion abutting against the tip of the second bobbin 9 which is the far-end one with respect to the LED 12. The LED 12 protrudes over the edge of the cutout of the reflective surface by about 3 mm. Particularly referring to FIG. 5, the first embodiment is in another status different from that of FIG. 4, where the non-reflective surface of the display plate 22 obscures the LED 12, thus the viewers can see this pixel as a dark color the same to that of the frame 4.

Figure 6:
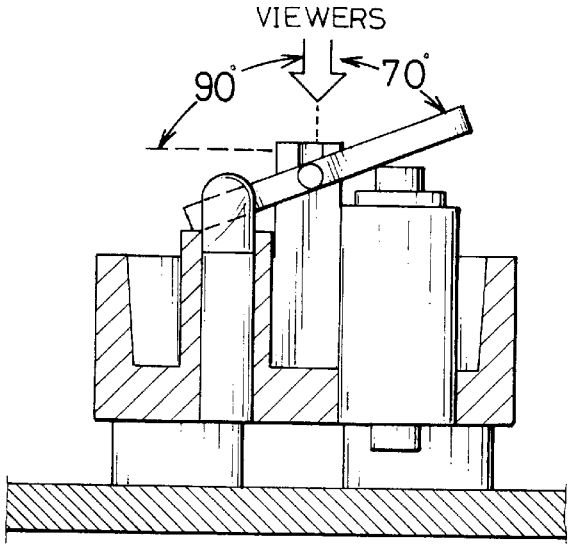
FIG. 6 is a second embodiment, which has a smaller size than that of the first embodiment, showing the reflective surface of the display plate facing to the viewers in a visible angle of 160°.
Figure 7:
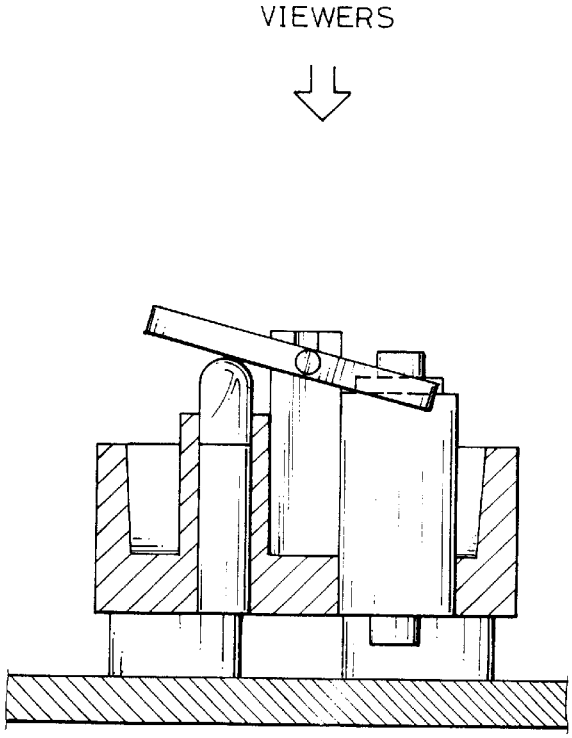
FIG. 7 is another status of the second embodiment, showing that the non-reflective surface of the display plate obscures the LED.

For some higher resolution applications, the pixel size should be reduced accordingly. For example, FIG. 6 illustrates a second embodiment of this invention, which has a smaller size than that of the first embodiment, with the length of each pixel square being 10 mm. FIG. 6 illustrates the pixel in a first status where the reflective surface of the display plate faces the viewers at a visible angle of 160°. FIG. 7 illustrates a second status of the second embodiment, where the non-reflective surface of the display plate obscures the LED 12.

What is claimed is:

1. A magnetically operated display unit comprising:

a frame comprising a single color, a plate pivotably mounted on the frame and including a first surface of a color different from that of the frame and a second surface of a color identical to that of the frame, a magnet, having two tips, embedded in the plate, a first bobbin and a second bobbin which are reversely wound from each other and connected in parallel with each other and are mounted on the frame so that two tips of the magnet are located between two tips of the first bobbin and the second bobbin, a light emitting diode mounted on the frame, wherein the plate defines a cutout for receiving the light emitting diode and the tip of the first bobbin, wherein the light emitting diode includes a tip located on a level between the plate and the tips of the first bobbin and the tip of the second bobbin means to induce two opposite polarities to the first bobbin and the second bobbin.

2. A magnetically operated display unit according to claim 1 wherein the frame includes a base defining two apertures through each of which a corresponding one of the first bobbin and the second bobbin is inserted.

3. A magnetically operated display unit according to claim 1 including a reflector attached to the first surface of the plate, the reflector including a color different to that of the frame.

4. A magnetically operated display unit according to claim 1 wherein the frame and the plate are made of plastic having a conductive agent added thereto in an amount sufficient to cause the frame and the plate to be conductive.

5. A magnetically operated display unit according to claim 1 further including two arms projecting upwardly from the frame and two fingers projecting upwardly toward a terminating tip from each of the arms, each of the fingers including an inner face opposite to the remaining one of the fingers and a bulbous portion disposed on the inner face thereof near the tip thereof thereby defining a narrow entrance to a recess defined between the two fingers.

6. A magnetically operated display unit according to claim 1 wherein said plate comprises at least two diagonally disposed areas, and wherein the pivoting axis of said plate is along a diagonal line disposed between diagonally opposed areas.

7. A magnetically operated display unit according to claim 6 wherein said plate comprises at least one remote area which is disposed remote from said diagonal lines, and wherein said light emitting diode is disposed in said remote area.

8. A magnetically operated display unit according to claim 1 wherein said light emitting diode comprises a lens means which is disposed relative to said first side of said plate to permit a viewing angle such that it casts light on said first surface of said plate under low light conditions.

9. A magnetically operated display unit according to claim 1 further including closed plate means covering said light emitting diode which is so disposed as to substantially obscure the visibility of said light emitting diode when said second surface is exposed, to thereby provide a maximum contrast between said first surface and said second surface.

10. A magnetically operated display unit according to claim 4 wherein said plate comprises a plastic material and said conductive additive is substantially non-magnetic.

11. A magnetically operated display unit according to claim 4 further comprising a circuit means in electrical contact with said conductive plate sufficient to substantially dissipate electrostatic build up in said plate.

12. A magnetically operated display unit according to claim 1 wherein said light emitting diode comprises a lens where the top of the lens is located above said first side of said plate by at least 0.3 millimeter up to 3 millimeters, thereby permitting a viewing angle no less than 160° for both day-time and night-time viewing.

13. A magnetically operated display unit according to claim 1 further comprising two tubular socket integrated with the frame for respectively receiving and retaining the first bobbin and the second bobbin.

* * * * *